US005222447A

United States Patent [19]

Joshi et al.

[11] Patent Number: 5,222,447

[45] Date of Patent: Jun. 29, 1993

[54] CARBON BLACK ENRICHED COMBUSTION

[75] Inventors: Mahendra L. Joshi, Altamonte Springs, Fla.; Marvin E. Tester, Charlotte, N.C.

[73] Assignee: Combustion Tec, Inc., Apopka, Fla.

[21] Appl. No.: 886,068

[22] Filed: May 20, 1992

[51] Int. Cl.[5] ..... F23C 1/00

[52] U.S. Cl. ..... 110/261; 110/101 CC; 110/347; 431/4; 431/284

[58] Field of Search ..... 110/260, 261, 347, 101 CC; 431/4, 8, 284, 285

[56] References Cited

U.S. PATENT DOCUMENTS 3,656,878 4/1972 Wright .
3,827,851 8/1974 Walker .
3,859,935 1/1975 Walker .
4,015,951 4/1977 Gunnerman .
4,249,471 2/1981 Gunnerman .
4,761,132 8/1988 Khinkis .
4,780,136 10/1988 Suzuki .
5,048,433 9/1991 Green et al. ..... 110/260

*Primary Examiner*—Edward G. Favors
*Attorney, Agent, or Firm*—Speckman, Pauley & Fejer

[57] ABSTRACT

A process and apparatus for combustion of carbon black enriched gaseous hydrocarbon fuels in which carbon black particles are entrained in a carrier fluid and injected through a center nozzle of a fluid injector into a combustion chamber, the fluid injector having an outer nozzle concentrically disposed around the center nozzle forming an annular chamber between the center nozzle and the outer nozzle through which at least a first portion of a gaseous hydrocarbon fuel is injected into a combustion chamber forming a carbon black enriched gaseous hydrocarbon fuel. The carbon black enriched gaseous hydrocarbon fuel is subsequently mixed with combustion air and burned producing a highly luminous flame.

13 Claims, 4 Drawing Sheets

CARBON BLACK ENRICHED COMBUSTION

BACKGROUND OF THE INVENTION

1. Field of the Invention

This invention relates to a process and apparatus for combustion of carbon black and natural gas in a combustion chamber to produce a luminous flame and maintain low-pollutant emissions. In particular, this invention relates to a process and apparatus for combustion of a carbon black enriched gaseous hydrocarbon fuel.

2. Description of the Prior Art

In many high temperature industrial applications, such as glass melting furnaces, it is desired to provide a highly luminous flame to improve radiant heat transfer rate to the furnace load resulting in increased furnace production rate and increased furnace thermal efficiency. When generating such highly luminous flames, environmental considerations require that pollutant emissions, including nitrogen oxide emissions, be maintained at a low level. Highly luminous flames are typically generated in the combustion of both coal and fuel oils. However, combustion of solid and liquid fuels is difficult to control and typically results in high pollutant emission rates requiring treatment of the flue gases to reduce pollutant emissions to an acceptable level. The combustion of gaseous hydrocarbon fuels, such as natural gas, produces flames having lower luminosity than flames produced by solid or liquid fuel combustion. However, combustion of gaseous hydrocarbon fuels generally produces substantially lower pollutant emissions than the combustion of solid or liquid fuels, and thus, gaseous hydrocarbon fuels, such as natural gas, are preferred for many industrial applications.

Methods for producing highly luminous flames in the combustion of gaseous hydrocarbon fuels are known in the prior art. One such method is simply to combust the gaseous hydrocarbon fuel under fuel rich conditions, thereby generating large amounts of carbon monoxide and some soot, both of which have high emissivities. However, this technique also produces flue gases containing high levels of pollutant emissions which must be removed, or otherwise eliminated, before being exhausted into the atmosphere.

U.S. Pat. No. 4,761,132 teaches a two-stage process and apparatus for producing a highly luminous flame in which a portion of the total fuel to be combusted is cracked in a cracking chamber under fuel rich conditions with oxygen rich gas and the cracked products including uncracked fuel, carbon monoxide, hydrogen, carbon dioxide, water, soot, some inerts, and a second portion of fuel are combusted in a combustion chamber.

U.S. Pat. No. 3,656,878 teaches a high luminosity burner in which products of combustion, which include soot particles, are burned with a second fuel such as natural gas. Incomplete combustion of a first fuel in a diffusion flame is used to produce a controlled quantity of solid soot particles which, along with other products of the diffusion flame combustion, move downstream where they are again combusted with a gaseous fuel in the presence of excess air to produce a secondary flame which has luminosity greater than the luminosity normally associated with the combustion of gaseous fuels.

U.S. Pat. No. 3,827,851 and related U.S. Pat. No. 3,859,935 relate to a combination oil, gas and/or solids burner. The '851 patent teaches operation of the burner apparatus with oil, gas and/or particulate solid material in which the particulate solid fuel is preferably wood, plastic, coal or other suitable substitutes which can be formed into relatively small particle sizes so that the fuel burns in suspension. The particulate solid fuel is introduced into the combustion chamber by either blowers, screw augers, conveyer belts or the like. The '935 patent teaches a process for using the apparatus taught by the '851 patent in which a combination burner structure is provided with an inner burner for oil and/or gaseous fuels, mounted with a refractory primary combustion chamber and a wood air mixture passageway surrounding the oil and/or gas burner. During the process, particulate combustible material is introduced into the combustion chamber after having been dried.

U.S. Pat. No. 4,015,951 discloses fuel pellets for burning in industrial applications and a method for making such fuel pellets from organic fibrous materials. U.S. Pat. No. 4,249,471 teaches a method and apparatus for producing a combustible mixture of a solid fuel pellet made from organic fibrous material, as disclosed in the '951 patent, and a flammable gas or liquid fuel in which a blower forces the pulverized sold fuel into a conduit, the stream of pulverized fuel being tangentially added to the gaseous fuel entering a center conduit of the apparatus.

U.S. Pat. No. 4,780,136 teaches a method of injecting combustion resistant fuel into a blast furnace in which a measured portion of combustion resistant fuel is injected into a stream of hot blast air and a gaseous fuel is injected into the hot blast air independent of the pulverized fuel, the gaseous fuel being supplied to an outer peripheral area of the pulverized fuel.

SUMMARY OF THE INVENTION

It is an object of this invention to provide a process and apparatus for combustion of carbon black and a gaseous hydrocarbon fuel in a combustion chamber, in particular a glass melting furnace, to produce a luminous flame while maintaining low pollutant emissions. For purposes of this disclosure, carbon black is distinguishable from soot on the basis that carbon black contains more than about 97% carbon particles whereas soot is only about 90% carbon particles, the balance being other gaseous hydrocarbons and oils.

This and other objects are achieved in accordance with the process of this invention in which carbon black particles are entrained in a carrier fluid, preferably a gaseous hydrocarbon fuel, to form a carbon black/carrier fluid mixture. The carbon black/carrier fluid mixture is injected through a center nozzle of a fluid injector into a combustion chamber, the fluid injector having an outer nozzle concentrically disposed around the center nozzle forming an annular chamber between the center nozzle and the outer nozzle. A gaseous hydrocarbon fuel, preferably the same type of gaseous hydrocarbon fuel used as said carrier fluid, is injected through the annular chamber into the combustion chamber, forming a carbon black enriched gaseous hydrocarbon fuel in the combustion chamber. The carbon black enriched gaseous hydrocarbon fuel is mixed with combustion air introduced directly into the combustion chamber, forming a fuel/air mixture with a fuel/air ratio between about 0.02 and about 1.4 on a volume basis depending upon the gaseous hydrocarbon fuel used, and the resulting mixture is ignited.

The apparatus for combustion of a carbon black enriched gaseous hydrocarbon fuel in accordance with this invention comprises a center nozzle having a center nozzle tip secured to the outlet end thereof, an outer nozzle concentrically disposed around the center nozzle and forming an annulus between the center nozzle and the outer nozzle, means for longitudinally adjusting the relative position of the center nozzle tip and the outlet end of the outer nozzle, means for entraining the carbon black in the carrier fluid in communication with the center nozzle upstream of the outlet end of the center nozzle, and means for introducing a gaseous hydrocarbon fuel into the annulus connected to the outer nozzle.

The center nozzle tip secured to the outlet end of the center nozzle has an outer diameter which converges toward the longitudinal axis of the center nozzle in a direction away from the outlet end of the center nozzle and toward the combustion chamber. The outer nozzle has an inner diameter toward the outlet end of the outer nozzle in the form of a venturi. By adjusting the relative position of the center nozzle tip and the outlet end of the outer nozzle, the center nozzle tip is displaceable within the venturi formed by the inner diameter of the outer nozzle, thereby adjusting the flow of gaseous hydrocarbon fuel through the annulus around the center nozzle.

Means for entraining the carbon black in the carrier fluid, in accordance with one embodiment of this invention, comprise a carbon black storage vessel, means for controlling the amount of carbon black entrained in the carrier fluid in communication with the carbon black storage vessel, means for reducing the carbon black to particle form, and conveyer means for mixing the carrier fluid with the carbon black particles to form a carrier fluid/carbon black mixture and convey the carrier fluid/carbon black mixture into the center nozzle.

BRIEF DESCRIPTION OF THE DRAWINGS

These and other features of the invention will become more apparent from the following detailed description taken in conjunction with the drawings, wherein.

DESCRIPTION OF PREFERRED EMBODIMENTS

Figure 1:
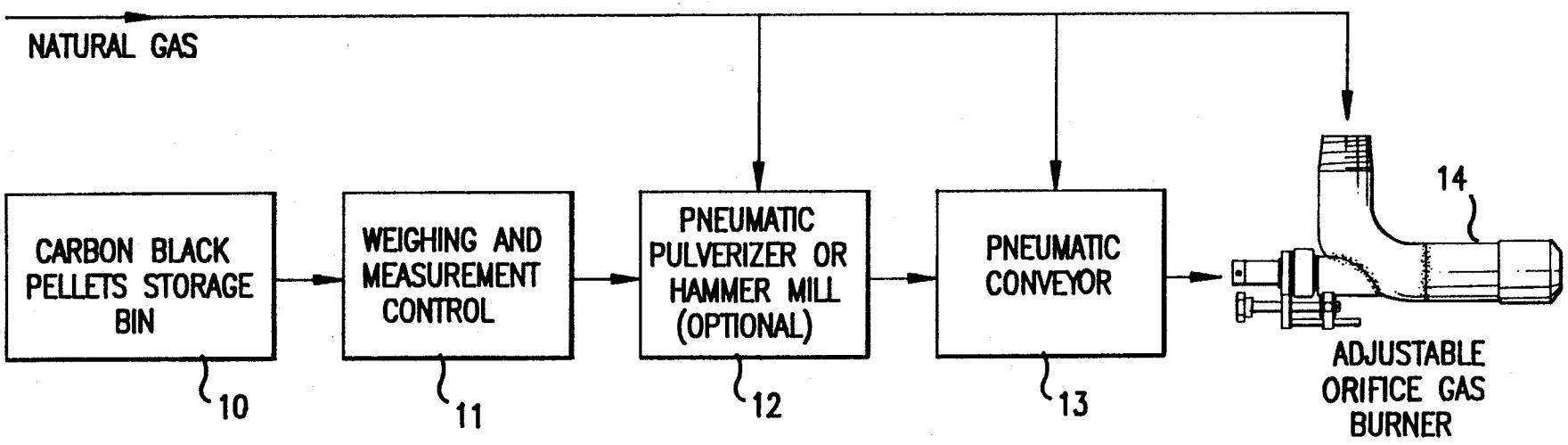
FIG. 1 is a schematic flow diagram of the process for combustion of carbon black enriched gaseous hydrocarbon fuels in accordance with one embodiment of this invention.

In the process for combustion of carbon black enriched gaseous hydrocarbon fuels in accordance with one embodiment of this invention as shown in FIG. 1, carbon black, preferably in the form of pellets, is conveyed from storage bin 10, preferably by gravity, to a means for weighing the carbon black which permits, by weight differential, accurate feeding of a predetermined quantity of carbon black to a dense phase pneumatic conveying system. The carbon black is pulverized, if necessary, by means for pulverizing 12 such as a pneumatic pulverizer or hammermill, after which it is transferred to the dense phase pneumatic conveying system in the form of pneumatic conveyer 13.

A carrier fluid, preferably a gaseous hydrocarbon fuel, is introduced into pneumatic conveyer 13 where it picks up carbon black particles and conveys them to the center nozzle of burner 14. The gaseous hydrocarbon fuel is also introduced into the outer nozzle of burner 14 for injection into the combustion chamber together with the mixture of carrier fluid and carbon black flowing through center nozzle 24 of burner 14.

Figure 2:
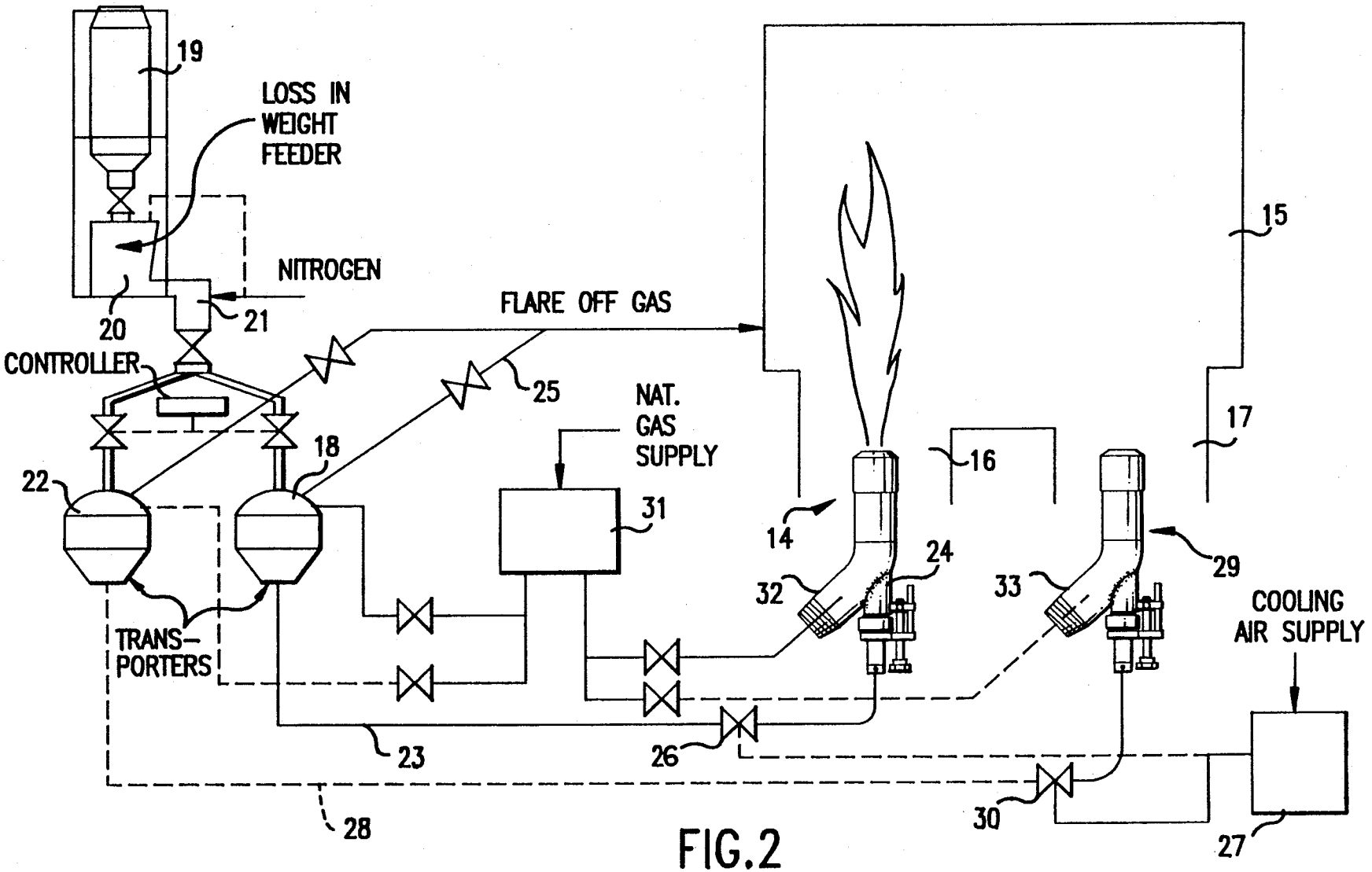
FIG. 2 is a schematic flow diagram of the process for combustion of carbon black enriched gaseous hydrocarbon fuels in accordance with one embodiment of this invention as applied to an end-fired glass regenerative furnace.

FIG. 2 shows a specific example in accordance with one embodiment of this invention as applied to an end-fired regenerative furnace 15. For purposes of this example, the left side port 16 is firing and right side port 17 is off. Carbon black pellets, wetted bedded carbon black, stored in supersack 19 is transferred by gravity to loss-in-weight feeder 20 which accurately feeds a predetermined quantity of carbon black to the system. The measured carbon black is fed to a pressure vessel, namely, transporter 18. An inert gas, preferably nitrogen, pressure seal 21 between loss-in-weight feeder 20 and transporter 18 is necessary to prevent any air leakage into the system. To take advantage of the cyclic nature of regenerative furnaces, two transporters 18, 22 are used such that when left side port 16 of end-fired regenerative furnace 15 is firing, transporter 18 is used for the conveying cycle while transporter 22 is being filled. When firing in end-fired regenerative furnace 15 is switched from left side port 16 to right side port 17, transporter 22 is used for conveying the carbon black to burner 29 while transporter 18 is filled with carbon black.

As left side port 16 commences firing, transporter 18 which was previously filled is activated. A gaseous hydrocarbon fuel, preferably natural gas, preferably at less than 25 psig, required to convey a measured quantity of carbon black to burner 14 in left side port 16 is gradually introduced through the top of transporter 18. The gaseous hydrocarbon fuel mixes with the carbon black in transporter 18 and forces the carbon black enriched gas through conveying line 23 to center nozzle 24 of burner 14. The process continues in this fashion until transporter 18 and conveying line 23 are free of carbon black. A sufficient time is provided to purge transporter 18 and conveying line 23.

A pressure switch is used to monitor the pressure of the carrier fluid in transporter 18 and is activated at a predetermined low pressure setting to turn off the high pressure carrier fluid supply to transporter 18 and allow the residual fluid volume to transfer into flare off line 25 vented to furnace 15 at a suitable location. The pressure switch also activates a three port valve 26 at burner 14 which allows cooling air to flow into center nozzle 24 of burner 14 during the period when left side port 16 is not firing. The amount of cooling air provided by cooling air supply 27 is set on the basis of furnace firing rate and flue volume.

Upon completion of the firing cycle in which left side port 16 is fired, firing is switched to right side port 17 utilizing transporter 22 conveying line 28, 3-way valve 30 and burner 29. Carrier fluid for both firing cycles is provided to transporters 18, 22 from carrier fluid supply 31. By a periodic switching, carrier fluid supply 31 provides a remaining portion of carrier fluid, about 25 percent to 100 percent of the total carrier fluid required, to outer nozzle 32 of burner 14 for the duration of the firing cycle through left side port 16. At the end of the firing cycle, the carrier fluid is switched to right side port 17, which would now be in a firing mode.

Although specifically shown as applied to an end-fired regenerative furnace, the process of this invention may be applied to other furnaces including side-fired regenerative furnaces, unit melters, oxy/fuel furnaces and recuperative furnaces.

Figure 3:
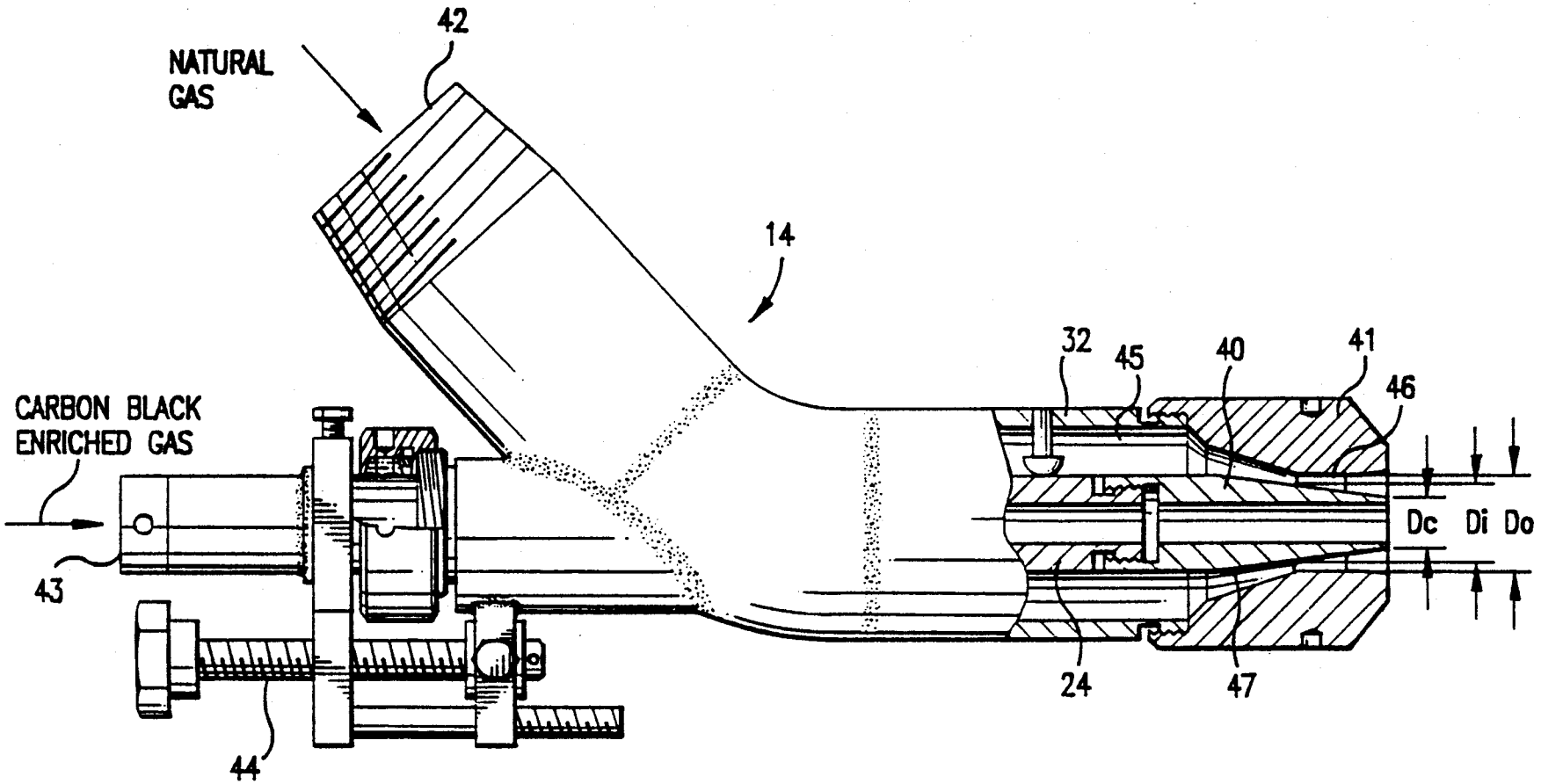
FIG. 3 is a schematic diagram in partial cross section of an apparatus for combustion of a carbon black enriched gaseous hydrocarbon fuel in accordance with one embodiment of this invention.

FIG. 3 shows a schematic diagram of an apparatus for combustion of a carbon black enriched gaseous hydrocarbon fuel in accordance with one embodiment of this invention. The apparatus for carbon black enriched combustion can be utilized on side-and end-fired regenerative furnaces. Hot combustion air is supplied from the furnace regenerators and delivered to the furnace through a furnace port. Burner 14, 29 introduces a carbon black enriched carrier fluid and a remaining fuel at the port, from either an over-port position, a through-port position, a side-of-port position, or an under-port position.

Burner 14 features two separate orifices for carrier fluid injection. The carbon black enriched carrier fluid, preferably comprising about 0 to about 75 percent of a total amount of gaseous hydrocarbon fuel, preferably natural gas, to be burned, is injected from center nozzle 24 through center nozzle tip 40. The remaining gaseous hydrocarbon fuel, about 25 to 100 percent of the total gaseous hydrocarbon fuel combusted, is injected through an annulus formed by center nozzle tip 40 and the outlet end of outer nozzle 45, typically in the form of burner tip 41. The ratio of carbon black particles to natural gas varies between about 0.0001 to about 0.05 pounds per cubic foot of natural gas. The annulus formed by center nozzle tip 40 and burner tip 41 is adjustable to maintain a given flame length and shape within a specific furnace by altering the gaseous hydrocarbon fuel velocity. The annular area is varied, preferably in the range of 2.5:1 to 3:1 to allow optimum burner operation. To adjust the annulus, center nozzle 24, and hence center nozzle tip 40 are longitudinally adjustable in and out of burner tip 41 by adjustment mechanism 44. Center nozzle tip 40 is provided with a tapered outer diameter 47 which tapers toward the outlet of burner tip 41. This tapered geometry permits the annular area surrounding center nozzle tip 40 to be varied as center nozzle tip 40 is longitudinally adjusted in and out of burner tip 41 by adjustment mechanism 44.

Figure 4:
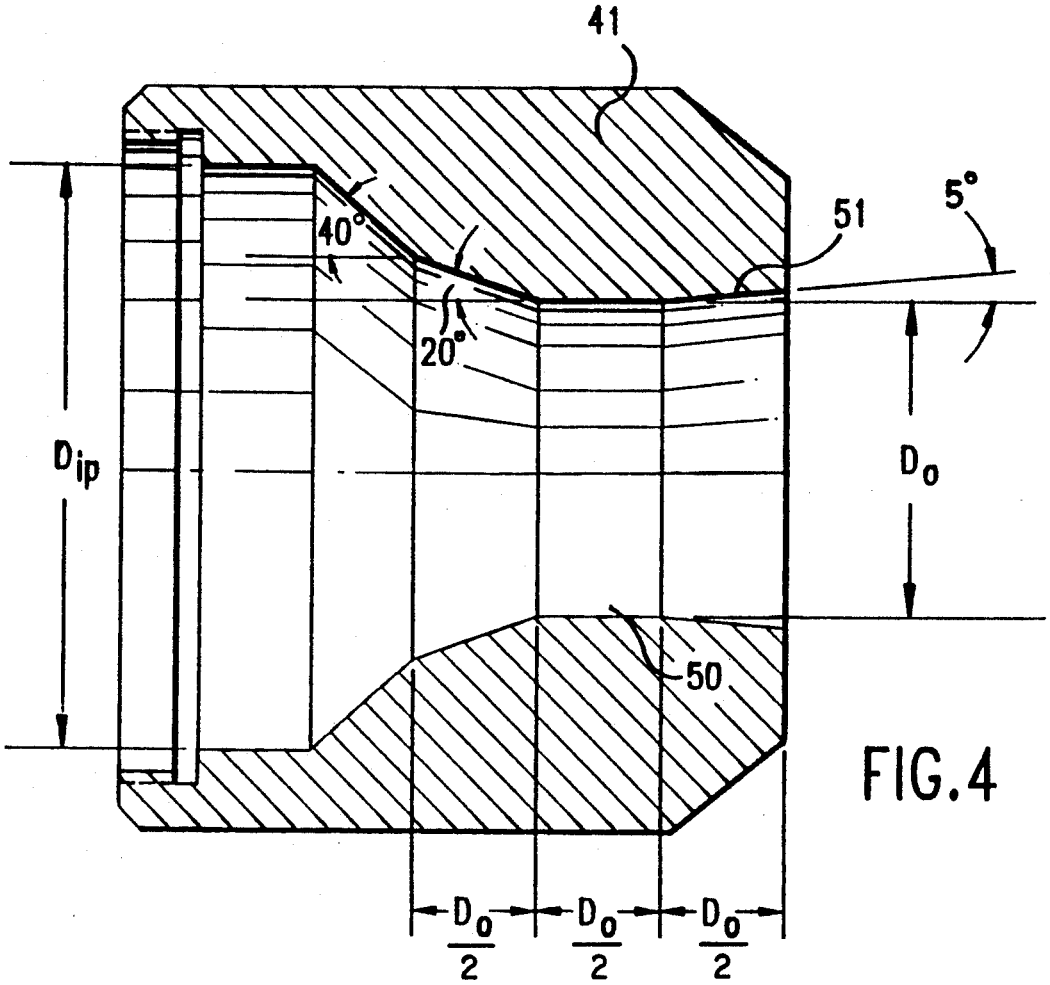
FIG. 4 is a schematic diagram of a burner tip for the apparatus shown in FIG. 3.

FIG. 4 shows a design for burner tip 41 in accordance with one embodiment of this invention for natural gas firing at flow rates between about 500 to about 24,000 standard cubic feet per hour. Burner tip 41 is mounted to the end of outer nozzle 32 having an internal diameter $D_{ip}$ which ranges from about 1½ inches to about 4 inches, depending on firing rate. Burner tip 41 has a throat section of diameter $D_o$ and a length of $D_o/2$ downstream of throat section 50 is recovery section 51 having about a 5° divergence and a length $D_o/2$. The approximate range of $D_o$ for various firing rates varies between about 0.3 inches to about 3 inches.

Figure 5:
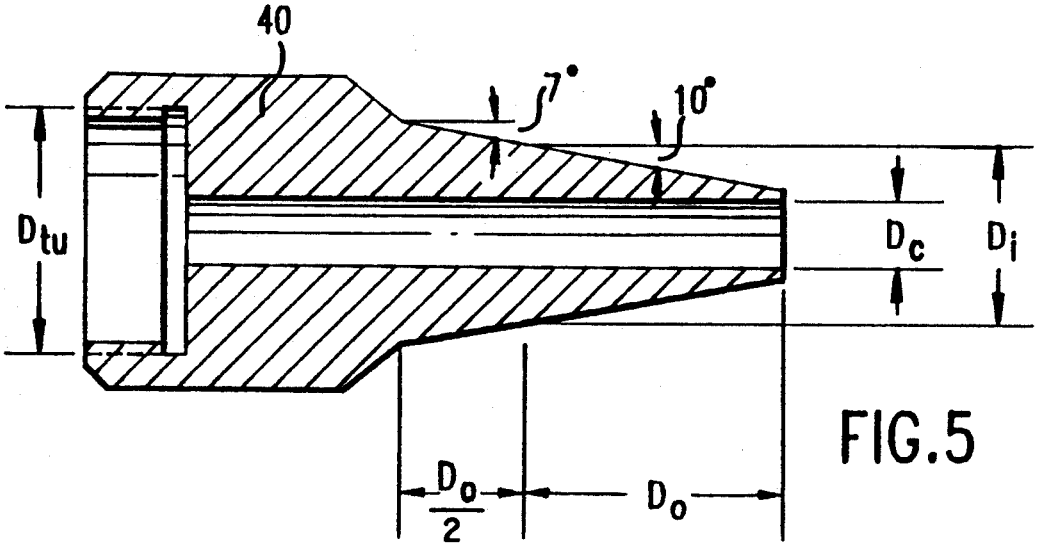
FIG. 5 is a schematic diagram of a center nozzle tip for the apparatus as shown in FIG. 3.

FIG. 5 shows center nozzle tip 40 which is attached to the outlet end of center nozzle 24. The most critical dimension of center nozzle tip 40 is designated as $D_i$ which dimension generates a minimum annular area through which the fuel flows through burner tip 41. Movement of center nozzle tip 40 over a range approximately equivalent to the diameter $D_o$ of throat section 50 changes the annular flow area and velocity of the gaseous hydrocarbon fuel leaving the burner. The tapered external geometry, 7° and 10° as shown, allows the variation of annular area formed by $D_o$ and $D_i$. The minimum area is obtained when center tip nozzle 40 is flush with the burner tip 41 and annular area between $D_o$ and $D_i$ is at a minimum. When center nozzle tip 40 is retracted back in burner tip 41, the flow area through burner tip 41 opens up to a maximum, the resulting area no longer being annular but rather being a solid jet of diameter $D_o$.

Center nozzle tip 40 also serves the function of conveying carbon black enriched carrier fluid through burner tip 41 into the furnace. The internal diameter of center nozzle tip 40, designated as $D_c$, is variable in the range of about 0.2 inches to about 1.5 inches depending on the firing capacity and furnace firing configuration. The opening in center nozzle tip 40 having diameter $D_c$ also serves the purpose of cooling the apparatus during the off-side firing of a regenerative furnace. A cooling air flow, about 5 to about 20 standard cubic feet per minute, depending on the burner firing capacity, is directed through center nozzle tip 40 when burner 14, 29 is not firing.

Center nozzle tip 40 is secured to the outlet end of center nozzle 24 for conveying the carbon black enriched carrier fluid. The outer diameter $D_{tu}$ of center nozzle 24 is preferably in the range of about 1 inch to about 3 inches depending on the firing capacity, furnace type and firing configuration. The inside diameter of center nozzle 24 is preferably the same as the inside diameter of center nozzle tip 40, namely $D_c$, which is variable in the range of about 0.2 inches to about 1.5 inches.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principals of the invention.

We claim:

1. A process for combustion of carbon black enriched gaseous hydrocarbon fuels comprising:

entraining a plurality of carbon black particles in a carrier fluid, forming a carbon black/carrier fluid mixture;

injecting said carbon black/carrier fluid mixture through a center nozzle of a fluid injector into a combustion chamber, said fluid injector having an outer nozzle concentrically disposed around said center nozzle forming an annular chamber between said center nozzle and said outer nozzle;

injecting at least a first portion of a gaseous hydrocarbon fuel through said annular chamber into said combustion chamber forming a carbon black enriched gaseous hydrocarbon fuel;

mixing said carbon black enriched gaseous hydrocarbon fuel with combustion air, forming a fuel/air mixture; and igniting said fuel/air mixture.

2. A process for combustion of carbon black enriched gaseous hydrocarbon fuels in accordance with claim 1, wherein said carrier fluid comprises a second portion of said gaseous hydrocarbon fuel.

3. A process for combustion of carbon black enriched gaseous hydrocarbon fuels in accordance with claim 2, wherein said second portion of said gaseous hydrocarbon fuel comprises between about 0% to about 75% of a total amount of said hydrocarbon fuel injected into said combustion chamber.

4. A process for combustion of carbon black enriched gaseous hydrocarbon fuels in accordance with claim 1, wherein a fuel/air ratio of said fuel/air mixture is between about 0.02 to about 1.4 on a volume basis.

5. A process for combustion of carbon black enriched gaseous hydrocarbon fuels in accordance with claim 1, wherein said gaseous hydrocarbon fuel is natural gas.

6. A process for combustion of carbon black enriched gaseous hydrocarbon fuels in accordance with claim 5, wherein a ratio of said carbon black particles to said natural gas is between about 0.0001 pounds per cubic foot of said natural gas to about 0.05 pounds per cubic foot of said natural gas.

7. A process for combustion of enriched gaseous hydrocarbon fuels in accordance with claim 1, wherein said carrier fluid is natural gas.

8. An apparatus for combustion of a carbon black enriched gaseous hydrocarbon fuel comprising:

a center nozzle;

an outer nozzle concentrically disposed around said center nozzle and forming an annulus between said center nozzle and said outer nozzle;

adjustment means for longitudinally adjusting a relative position of a center nozzle outlet end of said center nozzle and an outer nozzle outlet end of said outer nozzle;

carbon black entrainment means for entraining carbon black in a carrier fluid, forming a carrier fluid/carbon black mixture, in communication with said center nozzle upstream of said center nozzle outlet end; and fuel inlet means for introducing a gaseous hydrocarbon fuel into said annulus connected to said outer nozzle.

9. An apparatus for combustion of a carbon black enriched gaseous hydrocarbon fuel in accordance with claim 8, wherein a center nozzle tip is secured to said center nozzle outlet end of said center nozzle, said center nozzle tip having a nozzle outer diameter which converges toward a longitudinal axis of said center nozzle in a direction away from said center nozzle outlet end of said center nozzle.

10. An apparatus for combustion of a carbon black enriched gaseous hydrocarbon fuel in accordance with claim 8, wherein said outer nozzle has an inner diameter toward said outer nozzle outlet end in a form of a venturi.

11. An apparatus for combustion of a carbon black enriched gaseous hydrocarbon fuel in accordance with claim 8, wherein said adjustment means for adjusting the relative position of said center nozzle outlet end of said center nozzle and said outer nozzle outlet end of said outer nozzle adjusts a flow velocity of said gaseous hydrocarbon fuel through said annulus.

12. An apparatus for combustion of a carbon black enriched gaseous hydrocarbon fuel in accordance with claim 8, wherein a ratio of the area of said annulus to an outlet end opening in said center nozzle tip is adjustable between about 2.5:1 to about 3.0:1.

13. An apparatus for combustion of a carbon black enriched gaseous hydrocarbon fuel in accordance with claim 8, wherein said carbon black entrainment means comprises a carbon black storage vessel, weight means for controlling an amount of carbon black entrained in said carrier fluid in communication with said carbon black storage vessel, means for reducing said carbon black to particle form in communication with said weight means, conveyor means for mixing said carrier fluid with said carbon black particles forming said carrier fluid/carbon black mixture and conveying said carrier fluid/carbon black mixture into said center nozzle.

* * * * *